US010030622B2

(12) United States Patent
Graham et al.

(10) Patent No.: US 10,030,622 B2
(45) Date of Patent: Jul. 24, 2018

(54) DISTRIBUTED FUEL INJECTION EQUIPMENT

(71) Applicant: DELPHI TECHNOLOGIES IP LIMITED, St. Michael (BB)

(72) Inventors: Mark S. Graham, Bristol (GB); Anthony Thomas Harcombe, Richmond (GB); Simon H. Phillips, Cinderford (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 232 days.

(21) Appl. No.: 14/902,658

(22) PCT Filed: Jul. 4, 2014

(86) PCT No.: PCT/EP2014/064306

§ 371 (c)(1),
(2) Date: Jan. 4, 2016

(87) PCT Pub. No.: WO2015/001079

PCT Pub. Date: Jan. 8, 2015

(65) Prior Publication Data

US 2016/0169181 A1 Jun. 16, 2016

(30) Foreign Application Priority Data

| | | |
|---|---|---|
| Jul. 5, 2013 | (EP) | 13175394 |
| Oct. 2, 2013 | (GB) | 1317441.2 |
| Nov. 19, 2013 | (GB) | 1320374.0 |

(51) Int. Cl.

| | |
|---|---|
| ***F02M 69/22*** | (2006.01) |
| ***F02M 63/02*** | (2006.01) |
| ***F02M 55/02*** | (2006.01) |

(52) U.S. Cl.
CPC ..... *F02M 63/02* (2013.01); *F02M 55/02* (2013.01); *F02M 2200/40* (2013.01)

(58) Field of Classification Search
CPC ..... F02M 63/02; F02M 55/02; F02M 55/04; F02M 2200/40
See application file for complete search history.

(56) References Cited

U.S. PATENT DOCUMENTS 2,851,026 A * 9/1958 Dahl ..... F02D 9/00 123/179.17
3,342,422 A * 9/1967 Millington ..... C07D 451/10 239/453

(Continued)

FOREIGN PATENT DOCUMENTS

DE 3010328 A1 9/1981
DE 10 2005 012928 A1 9/2006

(Continued)

OTHER PUBLICATIONS

International Search Report dated Jul. 25, 2014.

*Primary Examiner* — Hung Q Nguyen
(74) *Attorney, Agent, or Firm* — Joshua M. Haines

(57) ABSTRACT

Fuel injection equipment includes a high pressure fuel source able to flow high pressure fuel via connecting pipes to a plurality of injectors. The fuel injection equipment is high pressure fuel reservoir-less, a distributed storage for high pressure fuel being arranged in the pipes and in the injectors.

1 Claim, 3 Drawing Sheets

(56) References Cited

U.S. PATENT DOCUMENTS

| | | | | |
|---|---|---|---|---|
| 3,977,376 | A * | 8/1976 | Reid | F02M 31/042 123/142.5 R |
| 5,207,203 | A * | 5/1993 | Wagner | F02M 37/0023 123/456 |
| 6,152,112 | A | 11/2000 | Coppola | |
| 6,220,224 | B1 * | 4/2001 | Matthies | F02M 55/02 123/468 |
| 7,490,592 | B2 * | 2/2009 | Kaneko | F02D 41/221 123/506 |
| 7,588,016 | B2 | 9/2009 | Pauer | |
| 7,603,984 | B2 | 10/2009 | Ganser | |
| 2004/0089732 | A1 * | 5/2004 | Nonoyama | F02M 55/02 239/88 |
| 2004/0200457 | A1 * | 10/2004 | Gottemoller | F02M 55/002 123/468 |
| 2006/0000450 | A1 * | 1/2006 | Ricco | F02M 47/027 123/447 |
| 2007/0169750 | A1 * | 7/2007 | Shafer | F02D 41/22 123/456 |
| 2008/0184962 | A1 * | 8/2008 | Pauer | F02M 51/0603 123/457 |
| 2008/0276906 | A1 * | 11/2008 | Thomas | F02D 41/2438 123/457 |
| 2014/0360469 | A1 * | 12/2014 | Ganser | F02M 55/001 123/445 |

FOREIGN PATENT DOCUMENTS

| | | | |
|---|---|---|---|
| DE | 102008017227 | A1 | 10/2009 |
| EP | 1079100 | A2 | 2/2001 |
| EP | 1 612 405 | A1 | 1/2006 |
| JP | s5639859 | U | 4/1981 |
| WO | 2007/009279 | A1 | 1/2007 |
| WO | 2011/085858 | A1 | 7/2011 |

* cited by examiner

DISTRIBUTED FUEL INJECTION EQUIPMENT

CROSS REFERENCE TO RELATED APPLICATIONS

This application is a national stage application under 35 USC 371 of PCT Application No. PCT/EP2014/064306 having an international filing date of Jul. 4, 2014, which is designated in the United States and which claimed the benefit of European Patent Application No. 13175394.9 filed on Jul. 5, 2013, Great Britain Patent Application No. 1317441.2 filed on Oct. 2, 2013, and Great Britain Patent Application No. 1320374.0 filed on Nov. 19, 2013, the entire disclosures each are hereby incorporated by reference in their entirety.

TECHNICAL FIELD

The present invention relates to rail-less high pressure fuel equipment having distributed fuel storage.

BACKGROUND OF THE INVENTION

High pressure fluid equipment commonly stores high pressure in a common rail prior to flow to the fuel to the injectors. The rail is a large component and recent optimization of engine layout render arrangement of a rail more complex.

Market demands rail-less equipment.

SUMMARY OF THE INVENTION

Accordingly, it is an object of the present invention to provide fuel injection equipment (FIE) for an internal combustion engine. The equipment comprises a high pressure fuel source able to flow high pressure fuel via connecting pipes to a plurality of injectors. The FIE is high pressure fuel reservoir-less, a distributed storage for high pressure fuel being arranged in the pipes and in the injectors. FIE are commonly known as "common-rail" systems while the FIE of the present application has no "rail".

In a first architecture of the FIE, the injectors are all directly connected to the source, each injector having one fuel inlet.

In another architecture of the FIE, the injectors are in-line connected so that they form a daisy chain, the source being connected to an injector of the line, and the injectors having two inlets.

In yet another architecture, the source is connected to another injector of the line, all the injectors having two inlets.

The FIE may comprise a second high pressure source connected to another injector of the line, all the injectors having two inlets.

Typically, the high pressure source comprises a high pressure pump. In certain architecture the source may comprise a plurality of high pressure pumps.

A FIE may comprise a plurality of pumps all connected to a union member. An alternative is that the pumps are connected in series.

The invention is also related to an injector having two inlets so that it can be arranged in a FIE as previously described. The inlets outwardly extend along an axis either parallel or set at an angle, relative to the main axis of the injector.

The inlets may be provided with threaded members so that the pipes can be connected via a nut.

The fuel injector is able to internally withstand from to 4 to 8 $cm^3$ of high pressure fuel.

BRIEF DESCRIPTION OF THE DRAWINGS

The present invention is now described by way of example with reference to the accompanying drawings in which.

DESCRIPTION OF THE PREFERRED EMBODIMENTS

In the following description, similar elements will be designated with the same reference numbers.

An internal combustion engine 10 is provided with high pressure fuel injection equipment (FIE) 12.

Five alternative architectures of FIE 12 are now described in reference to FIGS. 1 to 5.

Figure 1:
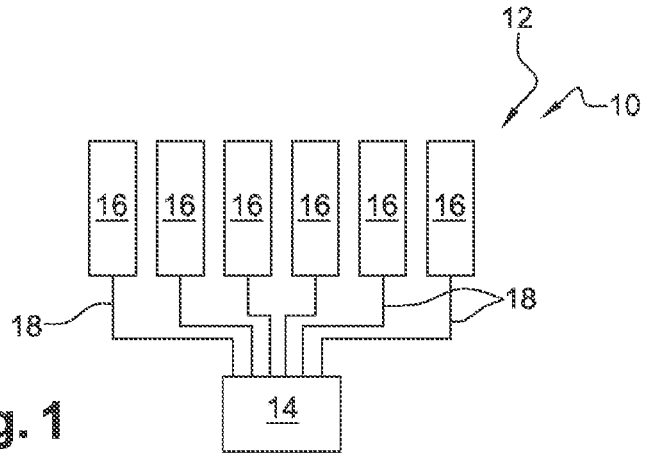
FIGS. 1 to 5 are five different schematics of exemplary architectures of fuel injection equipment wherein the injectors are directly connected to the pump.

A first architecture of the FIE 12 is represented in FIG. 1. It comprises a single high pressure pump 14, six injectors 16 and a pressure regulator 17, shown only in FIG. 14, the regulator 17 comprising a pressure sensor and a pressure valve able to open and re-route high pressure fuel toward a low pressure tank. Each of the injectors 16 is directly connected to the pump 14 via a connecting pipe 18 and, in operation the pump 14 flows high pressure fuel toward each of the injector 16. All FIE 12 examples have six injectors 16 but the teachings of the invention can directly be applied to engines 10 having another number of injectors 16, for instance four, five, eight, ten or more.

During an injection event, the fuel expelled through the spray holes of the nozzle 22 of an injector 16 empties, inside said injector 16, the space that is in the vicinity of the spray holes. Before the following injection event, this space is refilled with the high pressure fuel contained in the pipe 18 and inside the injector 16 itself. An internal reservoir 34, or storage pocket, of high pressure fuel may be accommodated inside the injector for instance as detailed in application number GB1317441.2 filed on 2 Oct. 2013.

Figure 2:
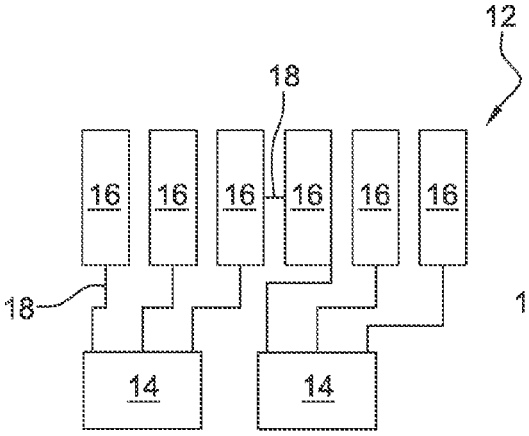

A second FIE 12 architecture is sketched in FIG. 2. This FIE 12 comprises two high pressure pumps 14, each supplying fuel to a bank of three injectors 16. Similar to the first embodiment, each injector 16 is connected directly to one of the pumps 14. In addition, and referencing the injectors 16 "first to sixth" from the left to the right of the figure, the first, second, fifth and sixth injectors have a single inlet 20 while third and fourth injectors each have two inlets 20. This fluid link between injectors three and four ensures balance of the pressure in the FIE so only one pressure sensor is required.

Figure 3:
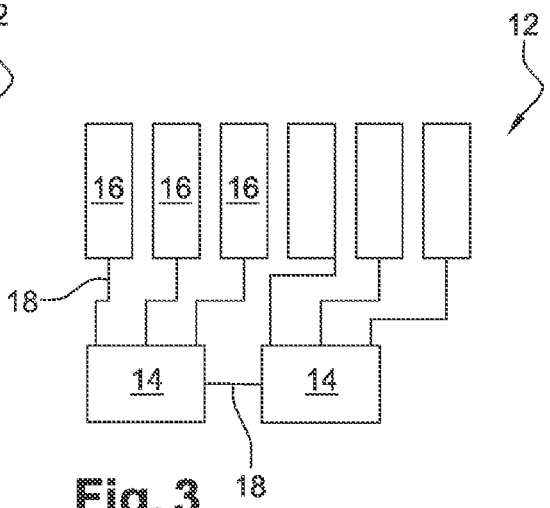

A third FIE 12 is sketched in FIG. 3. It is similar to the second FIE architecture with the exception that no link is made between two injectors while a pipe 18 interconnects the two pumps 14. In this third architecture, each injector 16 has a single inlet 20.

Figure 4:
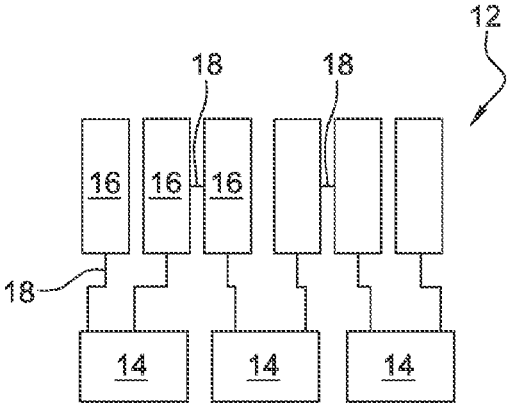

A fourth FIE 12 architecture is represented in FIG. 4. As can be observed it is indeed an alternative to the second architecture here above described. The fourth FIE 12 comprises three pumps 14 each directly supplying high pressure fuel to a bank of two injectors 16. Fluid communication is made between second and third injectors and also between fourth and fifth injectors 16. Consequently, first and sixth injectors 16 have a single inlet 20 while each other injector has two inlets 20.

Figure 5:
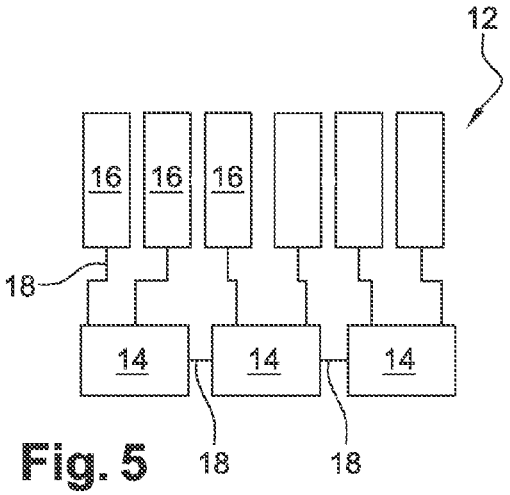

A fifth FIE 12 architecture is represented in FIG. 5. It is similar to the fourth architecture to the exception that no link is made between injectors while a pipe 18 interconnects the pumps 14. In this case, all the injectors 16 have a single inlet 20.

Further alternatives of FIE 12 architecture, not represented, can easily be implemented in increasing the number of pumps 14, creating fluid links between pumps or between injectors.

Five further FIE 12 architectures, referenced sixth to tenth, are now described in reference to FIGS. 6 to 10. In each of them the injectors 16 are connected in-line, forming a daisy chain.

Figure 6:
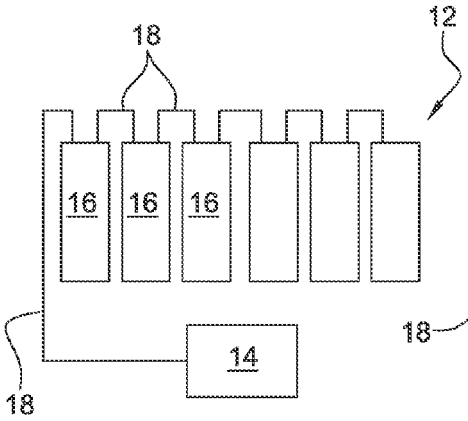
FIGS. 6 to 10 are five other different schematics of exemplary architectures of fuel injection equipment wherein the injectors form a daisy chain.

The FIE 12 of the sixth architecture, FIG. 6, comprises a single pump 14 which flows high pressure fuel to the first injector 16 of the daisy chain. Each of first to fifth injectors have two inlets 20, only the last of the chain has a single inlet 20.

In operation, the space emptied by an injection event is quickly refilled with high pressure fuel contained in the pipes 18 connected to the injector 16 and inside the injector 16. As previously detailed, an internal reservoir 34 or storage pocket 34 of high pressure fuel may be accommodated inside the injector for instance as detailed in application number GB1317441.2.

Figure 7:
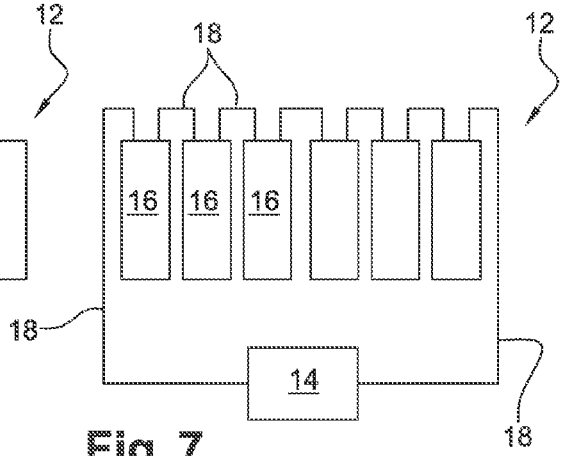

The seventh FIE 12 architecture, FIG. 7, differs from the sixth architecture in that the pump 14 is connected to the first and to the last injectors 16, the FIE 12 forming a closed loop. In this seventh architecture all the injectors 16 are provided with two inlets 20. The seventh architecture has the advantage to easily refill all the injectors 16 of the daisy chain.

Figure 8:
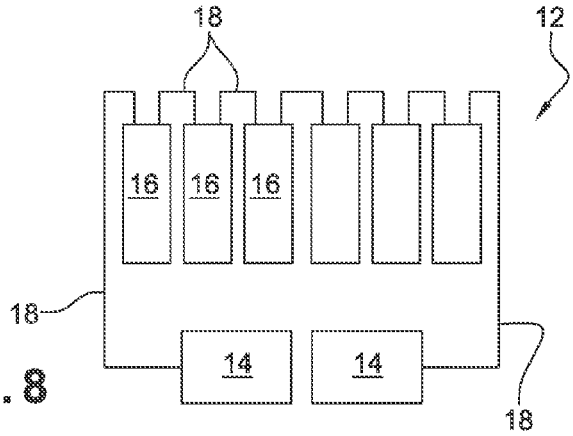

The eighth FIE architecture, FIG. 8, comprises two pumps 14 each one being connected to one injector 16. In the embodiment presented on the figure the first pump 14 is connected to the first injector 16 and the second pump 14 is connected to the sixth injector 16. Here again all the injectors 16 are provided with two inlets 20.

Figure 9:
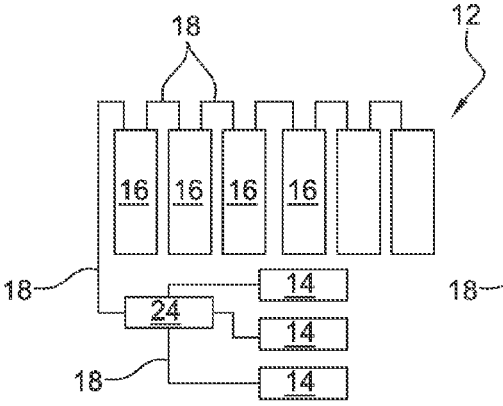

The ninth FIE 12 architecture, FIG. 9, differs from the sixth architecture in that it comprises a plurality of pumps 14; here three pumps are represented while another number is possible. All the pumps are connected to a union member 24 from which flows fuel toward the first injector 16.

Figure 10:
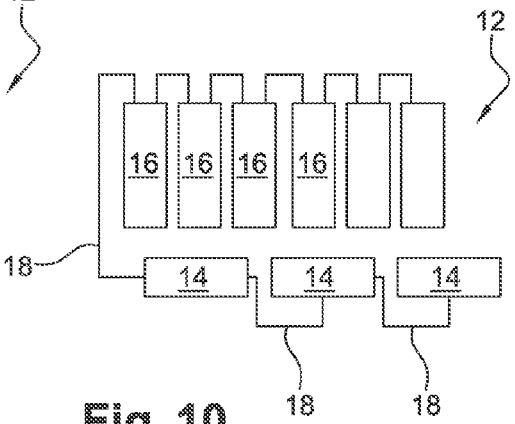

Another alternative is represented by the tenth FIE 12 architecture, FIG. 10, where three pumps 14 are connected in series, prior to flowing fuel toward the first injector 16.

In the ninth and tenth architectures, as in the sixth, only the last injector 16 has a single inlet 20 while the first to fifth injectors 16 have two inlets 20 each.

In previously described FIE architectures it is possible to commonize the utilization of only one type of injector 16, injectors provided with two inlets where, when needed the second inlet can be plugged for instance with a dummy short pipe.

Figure 11:
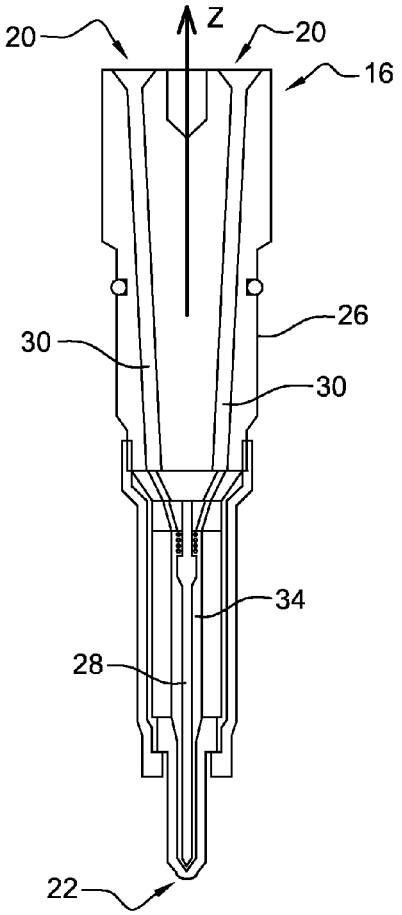
FIG. 11 is an axial section of an injector as per the invention.

An injector 16 having two inlets 20 is now described in reference to FIG. 11. The injector 16 extends along a main axis Z. The upper parts of the injector 16 are not represented and, without any limiting intention in choosing the vertical top to bottom orientation of FIG. 11, the injector 16 comprises a core 26 arranged above the nozzle 22 within which is reciprocally arranged a needle 28 opening or closing the spray holes of the nozzle 22. From two inlets 20, arranged in the head 32 of the injector 16, downwardly extend toward the nozzle 22 two high pressure channels 30. As can be seen, the two channels 30 merge around the needle 28, into an internal storage pocket 34 able, in operation, to quickly provide high pressure fuel to the spray holes.

While GB 1317441.2 is primarily based on low and medium duty injectors, this application was first thought for heavy duty FIE which injectors may withstand 4 to 8 $cm^3$ of high pressure fuel.

Figure 12:
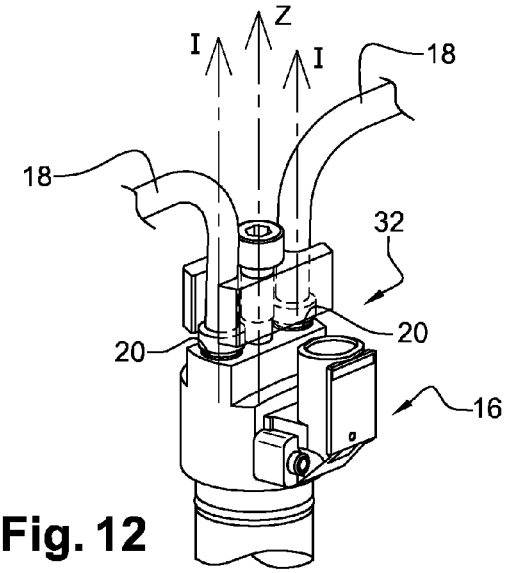
FIGS. 12 and 13 are isometric views of two different embodiments of injector heads.
Figure 13:
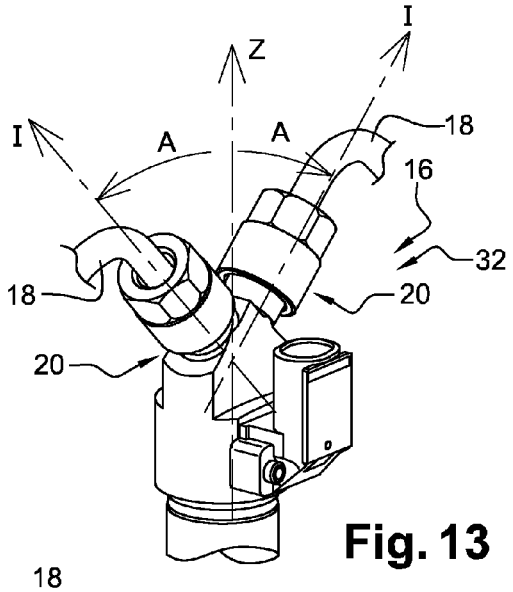

Two different embodiments of injector heads 32, each provided with two inlets 20, are represented on FIGS. 12 and 13. The inlets 20 extend along their own inlet axis I and, on the head 32 of FIG. 12, the inlet axes I are parallel to the main axis Z while, on the head 32 of FIG. 13 the axes I are at an angle A relative to the main axis Z. The angle A of FIG. 13 is approximately 45° but any other angle is possible. Multiple connecting arrangements of the pipes 18 onto the inlet 20 can be chosen, in particular the clamping connections taught in application EP13175394, now publication number EP2821630. The connection of FIG. 13 is based on a nut bolted onto a threaded portion of the inlet 20.

Figure 14:
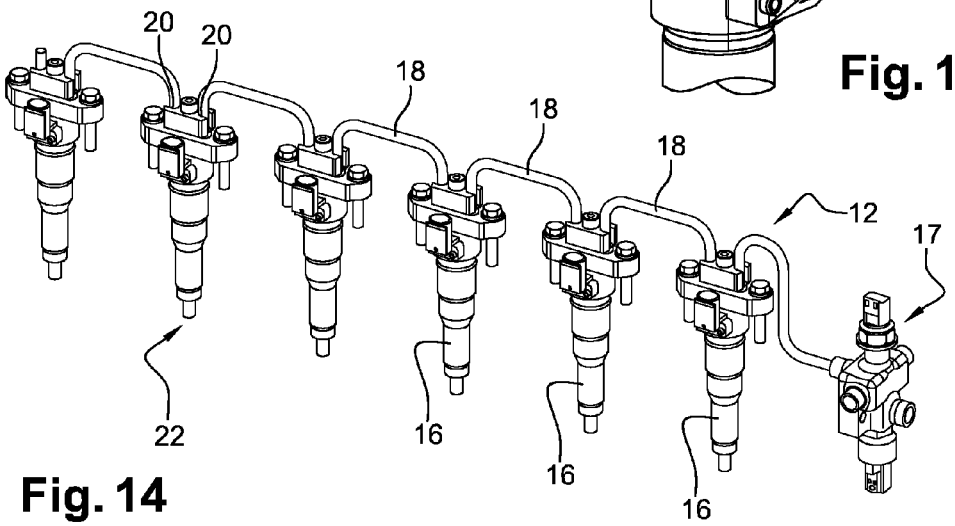
FIG. 14 is an exemplary embodiment of a daisy chain of injectors.

FIG. 14 represents an exemplary FIE 12 comprising a daisy chain of six injectors 16, at the end of the chain is arranged a pressure regulator 17.

The heads 32 have two inlets 20 and are similar to the head 32 of FIG. 12. A chain with heads 32 such as in FIG. 13 is not represented but can also be arranged in a similar way as shown on FIG. 14. At the end of the chain is arranged a pressure regulator 17.

The invention claimed is:

1. Fuel injector equipment comprising:

a high pressure fuel source able to flow high pressure fuel;

a plurality of connecting pipes which flow fuel from said high pressure fuel source; and a plurality of fuel injectors, each of said plurality of fuel injectors having an internal reservoir able to withstand 4 to 8 $cm^3$ of high pressure fuel and two inlets which outwardly extend along respective axes such that said respective axes are set at an angle or parallel to a main axis of said fuel injector, said plurality of fuel injectors being connected to said high pressure fuel source and to each other by said connecting pipes forming a daisy chain, said inlets being provided with threaded members which connect said plurality of connecting pipes to said plurality of fuel injectors via a nut;

wherein said fuel injection equipment is high pressure fuel reservoir-less;

wherein a distribution storage for high pressure fuel is arranged in said plurality of connecting pipes and in said plurality of fuel injectors;

wherein said high pressure fuel source comprises a plurality of high pressure pumps; and wherein said plurality of high pressure pumps are connected in series.

* * * * *